US009047769B2

(12) United States Patent
Lafon et al.

(10) Patent No.: US 9,047,769 B2
(45) Date of Patent: Jun. 2, 2015

(54) SYSTEM FOR AIDING THE GUIDANCE OF AN AIRCRAFT TRAVELLING AROUND AN AIRPORT ZONE

(71) Applicant: Thales, Neuilly sur Seine (FR)

(72) Inventors: Stéphanie Lafon, Merignac (FR); François Michel, Saint Medard en Jalles (FR)

(73) Assignee: Thales, Neuilly sur Seine (FR)

( * ) Notice: Subject to any disclaimer, the term of this patent is extended or adjusted under 35 U.S.C. 154(b) by 311 days.

(21) Appl. No.: 13/857,976

(22) Filed: Apr. 5, 2013

(65) Prior Publication Data

US 2014/0249739 A1 Sep. 4, 2014

(30) Foreign Application Priority Data

Apr. 6, 2012 (FR) ..... 12 01035

(51) Int. Cl.

| | |
|---|---|
| ***G08G 5/04*** | (2006.01) |
| ***G08G 5/06*** | (2006.01) |
| ***G08G 5/00*** | (2006.01) |

(52) U.S. Cl.

CPC ..... *G08G 5/04* (2013.01); *G08G 5/0021* (2013.01); *G08G 5/0078* (2013.01); *G08G 5/065* (2013.01)

(58) Field of Classification Search

CPC ..... G08G 5/065

USPC ..... 701/3, 16, 528; 348/149, 159, 970; 940/972, 979, 973

See application file for complete search history.

(56) References Cited

U.S. PATENT DOCUMENTS

| | | | | |
|---|---|---|---|---|
| 7,667,647 | B2 * | 2/2010 | Breen et al. | 342/450 |
| 8,068,038 | B2 * | 11/2011 | Engels et al. | 340/970 |
| 8,332,080 | B2 * | 12/2012 | Gutierrez-Castaneda et al. | 701/3 |
| 8,676,404 | B2 * | 3/2014 | Marty et al. | 701/3 |

(Continued)

FOREIGN PATENT DOCUMENTS

| | | |
|---|---|---|
| EP | 1 995 708 A1 | 11/2008 |
| EP | 2 325 825 A2 | 5/2011 |

(Continued)

OTHER PUBLICATIONS

French Search Report for Counterpart French Patent Application No. 1201035, 7 pgs. (Nov. 23, 2012).

*Primary Examiner* — Thomas G Black
*Assistant Examiner* — Wae Louie
(74) *Attorney, Agent, or Firm* — Blakely, Sokoloff, Taylor & Zafman LLP

(57) ABSTRACT

The general field of the invention is that of systems for aiding the guidance of a first aircraft travelling around an airport zone. The system according to the invention comprises:

- a set of databases comprising bulkiness and performance characteristics of the said first aircraft, geometric and technical characteristics of the airport zone and information about the air traffic in the immediate environment of the said first aircraft;
- calculation means making it possible to firstly determine a safety zone around the said first aircraft taking into account at least the position of the said aircraft, its size and the uncertainty in the measurement of its position; and then a taxiing indication on the basis of the information arising from the databases and the characteristics of the safety zone;
- viewing means displaying at least one view of the airport one in which the first aircraft is situated and a representation of the said taxiing indication.

5 Claims, 3 Drawing Sheets

(56) References Cited

U.S. PATENT DOCUMENTS

| | | | | |
|---|---|---|---|---|
| 8,737,684 | B2 * | 5/2014 | Meloche et al. | 382/103 |
| 8,744,768 | B2 * | 6/2014 | Gutierez-Castaneda et al. | 701/528 |
| 2007/0115165 | A1 * | 5/2007 | Breen et al. | 342/29 |
| 2010/0194602 | A1 * | 8/2010 | Engels et al. | 340/979 |
| 2010/0231721 | A1 * | 9/2010 | Meloche et al. | 348/159 |
| 2010/0292871 | A1 * | 11/2010 | Schultz et al. | 701/3 |
| 2011/0264312 | A1 * | 10/2011 | Spinelli et al. | 701/16 |
| 2011/0295501 | A1 * | 12/2011 | Gutierez-Castaneda et al. | 701/206 |
| 2014/0104428 | A1 * | 4/2014 | Meloche et al. | 348/149 |
| 2014/0225753 | A1 * | 8/2014 | Conrardy et al. | 340/972 |

FOREIGN PATENT DOCUMENTS

| | | | |
|---|---|---|---|
| EP | 2 327 962 | A2 | 6/2011 |
| FR | 2 917 222 | A1 | 12/2008 |
| FR | 2 935 524 | A1 | 3/2010 |

* cited by examiner

SYSTEM FOR AIDING THE GUIDANCE OF AN AIRCRAFT TRAVELLING AROUND AN AIRPORT ZONE

BACKGROUND OF THE INVENTION

1. Field of the Invention

The field of the invention is that of airport navigation of aircraft and more precisely that of the safety zones and distances surrounding the machine either in its immediate environment or in its environment in the near future.

2. Description of the Prior Art

During phases when an aircraft is taxiing around an airport, to avoid any incident, any collision between two machines, it is important that the crew have a perfect knowledge of the environment of their machine. For this purpose, the system of cockpit viewing units presents them with the situation of the surrounding traffic. The position of each aircraft can be recovered by virtue of the information provided by systems of ADS-B type signifying "Automatic Dependent Surveillance Broadcast". This presentation can be done in various ways.

By way of first example, it can be ensured in the so-called "HUC" head-up collimator of the machine. The most intuitive way of symbolizing the various other aircraft situated in the immediate environment of the machine is to represent them in a view compliant and/or non-compliant with their exact location. U.S. Pat. No. 7,342,514 entitled "Display of Automatic Dependent Surveillance (ADS-B) on Head-Up Display" illustrates this type of representation. Refer in particular to FIGS. 1 to 5 of this patent.

By way of second example, it is possible to represent in a so-called Head-Down viewing unit an aerial view of the airport zone in which the machine is situated. U.S. Pat. No. 7,194,342 entitled "Navigational instrument, method and computer program product for displaying ground traffic information" illustrates this type of representation. Refer in particular to FIG. 3 of this patent.

These various approaches afford information by way of indication allowing the crew to remain vigilant. In certain situations, this information does not make it totally possible to precisely monitor the behaviour of dangerous aeroplanes and therefore to comply scrupulously with the regulatory separation distances imposed between aeroplanes and vehicles on an airport.

Now, a certain number of ground collisions are due to poor assessment of the precise crowding of aeroplanes on runways. A pilot may, for example, decide to take off thinking that the runway is clear while an aeroplane still has part of its fuselage on the runway or else too close to the latter.

SUMMARY OF THE INVENTION

The aim of the invention is to offer the pilot a simple and intuitive means of avoiding this type of incident by offering him surveillance means based on targeted and precise information as well as an aid to the monitoring of the separation distances which takes into account the topography of the airport as well as the taxiing data provided by the air traffic control or "ATC".

The system according to the invention is therefore a system for aiding the guidance of aircraft travelling around airport zones. The object of the system is to monitor the ground separation distances between aeroplanes. This system uses varied input data to detect situations that are actually critical and avoid the issuing of untimely alerts, which would hamper pilots in their driving. These input data relate globally to the location, the type and the behaviour of surrounding aircraft, the carriers taxiing directives given by the air traffic control and also the integrity level of the data and the topography of the airport. This system issues taxiing indications tailored to the situation making it possible to avoid any collisions.

More precisely, the subject of the invention is a system for aiding the guidance of a first aircraft travelling around an airport zone, the said system comprising:

a first database comprising bulkiness and performance characteristics of the said first aircraft;

a second database comprising geometric and technical characteristics of the airport zone;

a third database comprising information about the ground traffic in the immediate environment of the said first aircraft;

first calculation means making it possible to determine a safety zone around the said first aircraft taking into account at least the position of the said aircraft, its size and the uncertainty in the measurement of its position:

second calculation means making it possible to determine a taxiing indication on the basis of the information arising from the first database, the second database, the third database and the characteristics of the safety zone;

viewing means displaying at least one view of the airport zone in which the first aircraft is situated and a representation of the said taxiing indication.

Advantageously, when the view of the airport zone is a compliant or perspective representation and when the taxiing indication is a stop directive for the first aircraft, the representation of the taxiing indication is a stop barrier comprising a symbolic representation of a second aircraft justifying this stop.

Advantageously, the orientation of the symbolic representation of the second aircraft is representative of its direction of travel with respect to the first aircraft or of its taxiing, either of its landing or of its takeoff.

Advantageously, the representation of the taxiing indication comprises indications relating to the topological distance separating the first aircraft from the second aircraft and the speed of the second aircraft and/or a stop time indication.

BRIEF DESCRIPTION OF THE DRAWINGS

The invention will be better understood and other advantages will become apparent on reading the nonlimiting description which follows and by virtue of the appended figures among which.

DETAILED DESCRIPTION

It should be noted that, in what follows, the terms aeroplane, carrier or machine are used interchangeably to designate an aircraft.

The system according to the invention is a system for aiding the guidance of an aircraft travelling around an airport zone. To operate, the system must be based on precise databases provided in real time relating essentially to:

The airport topographic data;

The position of aircraft present in the airport zone;

Their speed;

Their wingspan;

The carrier's taxiing directive.

Currently these data are provided with a few uncertainties notably in respect of the position of the aeroplanes, given by the GPS systems, and the airport data arising from the databases. It is necessary to take account of these uncertainties in order to determine safety distances and establish reliable directives.

To this end, it is necessary to estimate a safety zone around each machine into which other craft must not penetrate. The system comprises first calculation means making it possible to determine this safety zone around the various aircraft. It takes into account at least the position of each aircraft, its wingspan and the uncertainty in the measurement of its position. It is also possible to take into account the blast cone of the jets, a machine's wake turbulence after takeoff and the frontal zone required for the aeroplane to stop which depends essentially on its speed.

Figure 1:
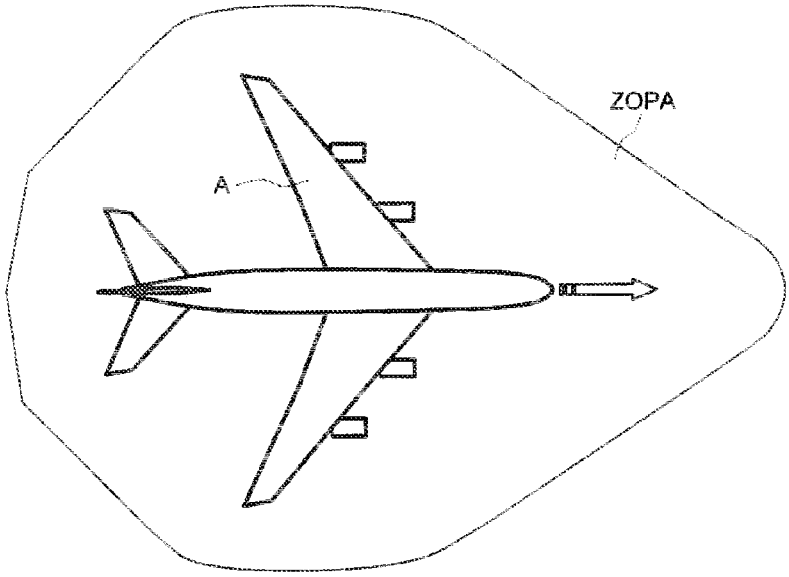
FIG. 1 represents a view of a safety zone around an aircraft.

In the subsequent description, this safety zone is called the Probable and Anticipated Occupancy Zone or "PAOZ". Knowing that an aeroplane is not presumed to place its wheels outside the limits of the travel lanes, any zone of the PAOZ passing beyond the overrun zones flanking the travel paths and which depend on the type of aeroplane will not be taken into account. By way of illustration, FIG. 1 represents in plan view a PAOZ surrounding an aircraft A of quad-jet type.

To ease the calculations, just the PAOZs of the aeroplanes close to the carrier may be estimated.

Subsequently, the system continuously verifies whether the carrier with which it is associated is or is not in a conflict situation. To this end, the system comprises second calculation means making it possible to analyse the situation of the carrier and to determine a taxiing indication on the basis of the information arising from the various databases and calculated characteristics of the safety zone.

These second means analyse the situation in a global manner by taking into account the position of the aeroplanes, their behaviour both in terms of speed and heading, the taxiing directive for the carrier and the airport structure. The proximity of two machines does not depend only on their actual separation distance but also on their positioning on the airport as a function of the possible connections between the various travel lanes. Indeed, two machines can be on two parallel taxiways at a relatively close distance but may not meet in the immediate future. In this case, the proximity distance is defined along the travel lanes and not in absolute terms. This proximity distance is called the topological distance.

If a dangerous situation is detected, to avoid wrongly alerting the carrier, the detection is refined by using the PAOZs surrounding each aircraft. The expression dangerous situation is intended to mean a situation where an aircraft is at risk either of hitting another aircraft, or of being disturbed by its wake very soon if it continues its course in short. In the case of substantiated conflict, the system alerts the pilot and aids him to assess the situation and to solve the problem. Dialogue between the system and the pilot is done essentially through viewing means displaying at least one view of the airport zone in which the first aircraft is situated and a representation of the said taxiing indication.

This information can be displayed either on the so-called "Head-Down" instrument panel viewing systems, or on the so-called "Head-Up" collimated, also denoted "HUC", viewing systems.

The presentations of information in an HUG are superimposed on the exterior landscape. It is therefore important that they be as simple and as clear as possible. A 3D representation of close aircraft is not the most effective solution in so far as this representation is necessarily complex and may pose problems of interpretation, notably of the positions and distances between aircraft.

Figure 2:
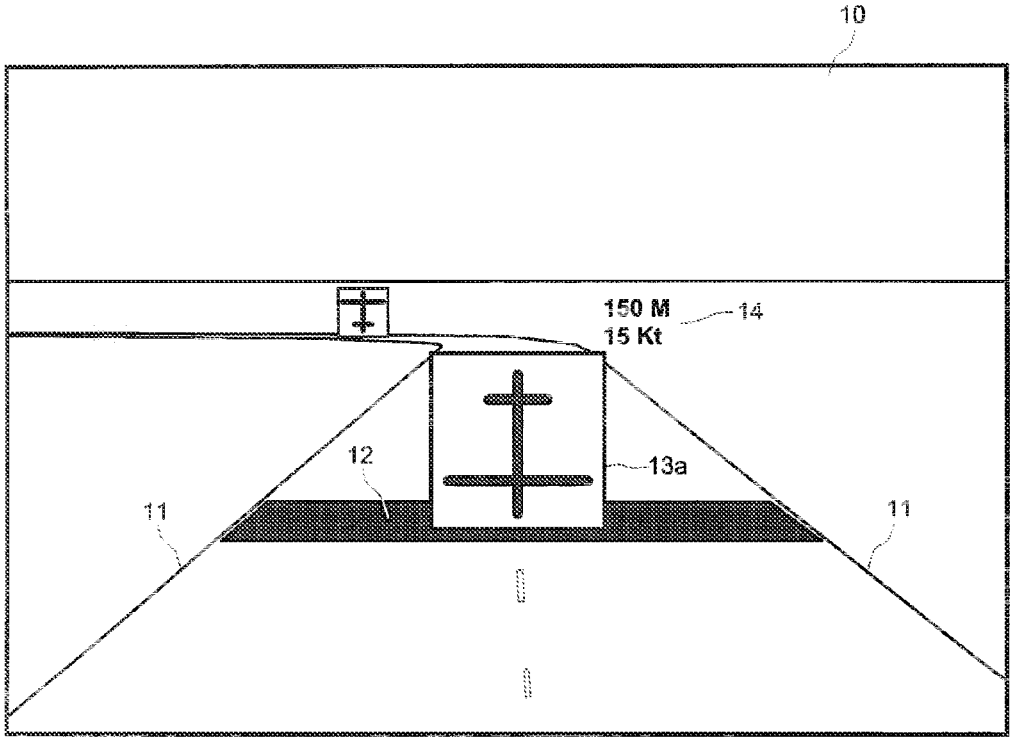
FIG. 2 represents a first exemplary display in perspective implemented in a system according to the invention.

A simple and ergonomic solution is for a simple barrier to be displayed in the HUC. FIG. 2 represents a simplified display 10 in an HUC presented to the pilot when his aircraft is travelling through an airport zone. The limits of the travel path 11 and a barrier 12 represented in black are distinguished in perspective in this figure.

This barrier must not be crossed, it may optionally be mobile, for example if the aeroplane is following another aeroplane. It comprises information 14 about the traffic which creates this danger zone. This information is by way of example, the distance from the aircraft to the safety barrier or its speed.

By way of first example, a braking directive, more or less urgent, can also be given to the pilots and is issued as a function of the distance from the aeroplane to the last braking limit so as to aid it not to cross the stop bar and penetrate into the danger zone. This limit may optionally be advanced to take account of the pilot's reaction time.

Figure 3:
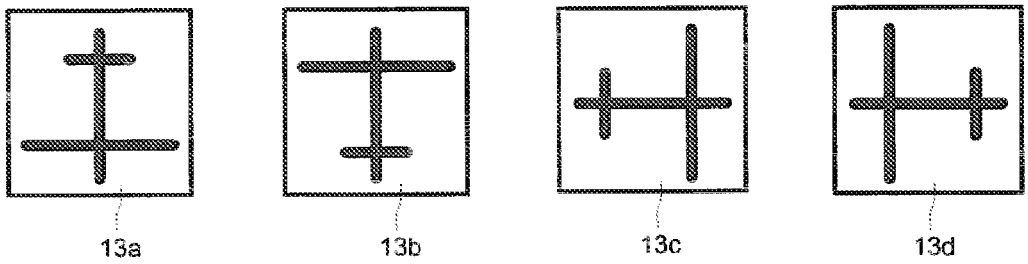
FIGS. 3 and 4 represent symbolic representations of an aircraft according to the invention.
Figure 4:
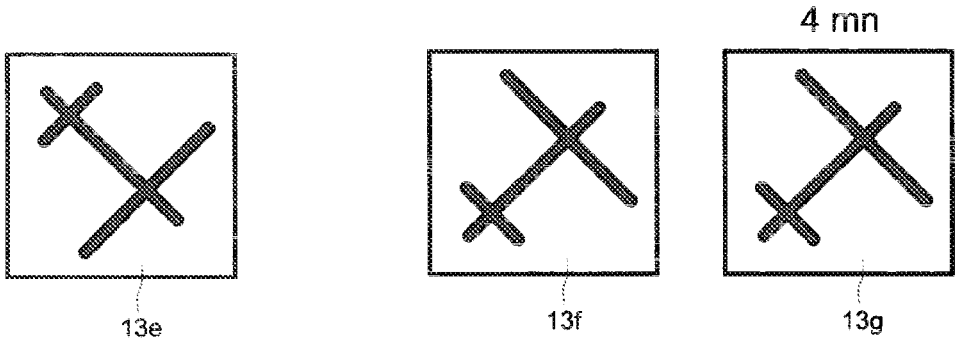

By way of second example, the system can display a symbol 13 representing the second aircraft which creates the danger. In FIGS. 2, 3 and 4, this symbol is the representation as three thick lines of a stylized aircraft. Of course, other representations are possible and remain within the framework of this invention.

The orientation of the symbolic representation of the second aircraft is representative of its direction of travel with respect to the first aircraft or of its taxiing, either of its landing or of its takeoff. Thus, in FIGS. 2 and 3, the second aircraft represented by the symbol 13*a* is travelling in the opposite direction to the first aircraft. Thus, in FIG. 3, the second aircraft represented by the symbol 13*b* is travelling in the same direction as the first aircraft, the second aircraft represented by the symbol 13*c* is arriving from the left and the second aircraft represented by the symbol 13*d* is arriving from the right. Thus, in FIG. 4, the second aircraft represented by the symbol 13*e* is landing and the second aircraft represented by the symbols 13*f* and 13*g* is taking off.

For aeroplanes that are taking off or landing, it is possible to add an indication giving the time of presence of the wake turbulence still present after takeoff or landing. A countdown can be displayed above the symbology once the aeroplane has passed so as to avoid mistakes as seen above the symbol 13*g* of FIG. 4 where the waiting time "4 mn" is displayed.

Figure 5:
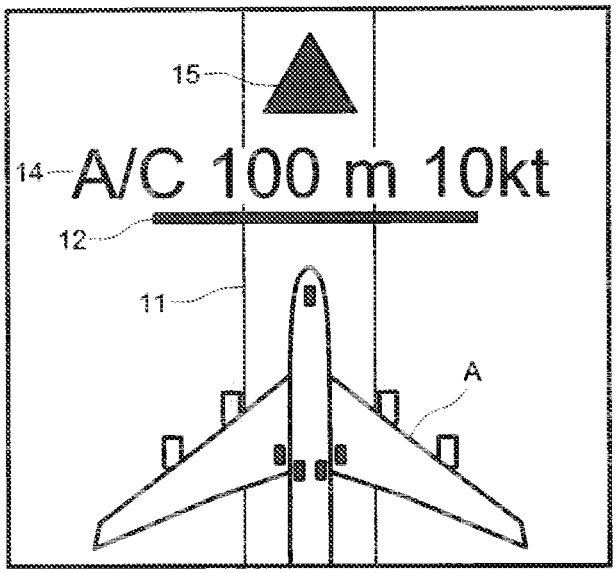
FIG. 5 represents a second exemplary display in plan view implemented in a system according to the invention.

It is also possible to represent a situation of conflict in plan view or noncompliant view as represented in FIG. 5. In this figure, the front of the machine A, the runway 11 on which it is travelling, the stop barrier 12 as well as an indication of the distance and of the directive speed are represented. The black triangle 15 symbolizes the dangerous machine. The orientation of this triangle makes it possible to determine the direction of travel of this machine.

Figure 6:
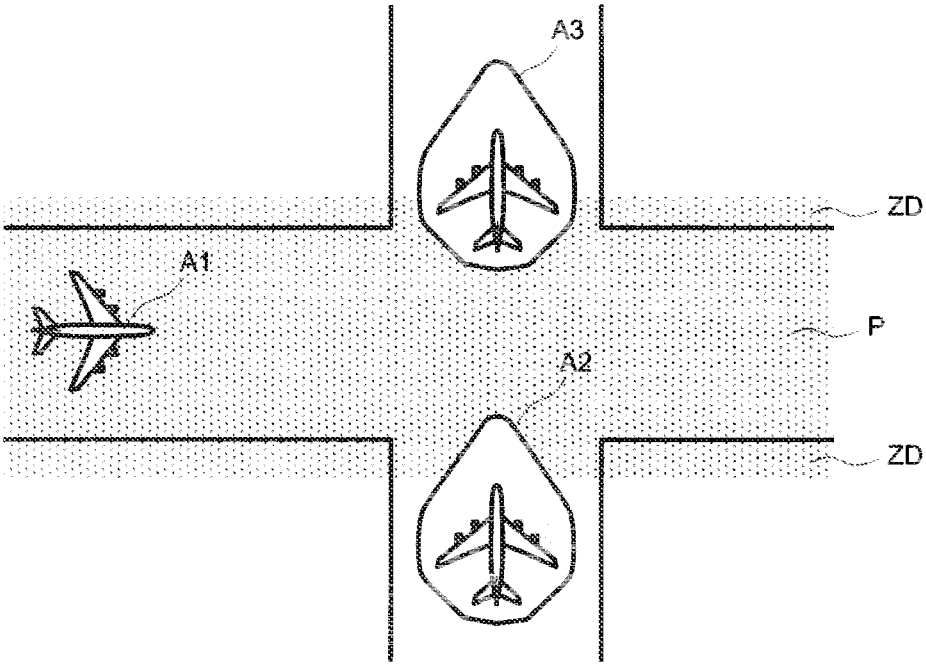
FIG. 6 represents a partial plan view of an airport zone comprising an aircraft in a situation of potential conflict with two other aircraft.

By way of examples of implementation of the system according to the invention, FIG. 6 represents a runway P intersection over which three machines denoted A1, A2 and A3 are travelling in various configurations and the various directives given by the guidance aid systems present in each aircraft. The machines A2 and A3 are surrounded by their respective PAOZs. The runway is prolonged by these overrun zones ZD.

In a first configuration, the lane on which the aircraft A1 is situated is a takeoff or landing lane. In this case, the system verifies the crowding of the runway before performing the least manoeuvre. To verify this crowding, it suffices to monitor the intersection of the PAOZs of the aeroplanes A2 and A3 with the runway P and its overrun zones ZD indicated in grey in FIG. 6. The aeroplane A3 is informed of the urgency of clearing the runway as quickly as possible whereas the aeroplane A2 must cross the runway to clear it since it is too late for it to be able to brake. The taxiing indication given to the aeroplane A1 depends at one and the same time on its intention such as runway clearance or takeoff, on its behaviour related to its speed and to its acceleration and on the behaviour of the other two machines A2 and A3.

For example, if the aircraft A3 has a nonzero speed allowing it to release the runway, that is to say its PAOZ will be outside of the zone comprising the runway and the overrun zones before the aeroplane A1 arrives in the zone of the crossing, the aeroplane A1 does not have any stop directive but just a warning directive. Knowing that the directives relating to runway environs are very strict, this typical case is merely hypothetical and has a very low probability of happening.

Conversely, if the speed of the aircraft A3 does not allow it to clear the runway in time, then the aeroplane A1 is halted before entering the danger zone.

If the taxiing intention of the aeroplane A2 is not known which may be either to cross the runway or to align itself and its PAOZ already being in the grey zone, the system gives the aeroplane A1 a stop directive whatever the speed of the aeroplane A2.

In a second configuration, the travel lane on which the aircraft A1 is situated is not a "runway", by assuming that this aircraft A1 has a "clearance" situated beyond the crossing, by analysing the situation of the aeroplane A3, the system verifies that, when the aeroplane A1 reaches the conflict zone, the aeroplane A3 will have already exited the danger area. The alarm is then unnecessary or should not be an alert of great importance as signalled above. If this is not the case, the system halts the aeroplane 1 before any collision. As regards the analysis of the situation related to the aeroplane A2, the system will have to request that aeroplane A1 stop since aeroplane A2 is too far advanced on the lane and will not therefore have time to brake and to comply with the safety limit.

The previous cases refer only to perpendicular lanes. The position of the stop bar starts at the level of the intersection of the two overrun zones when the latter are not perpendicular.

Generally, the analysis of the situations is done as a function of the carrier's taxiing directive. Indeed, if the carrier has to bear right at the next intersection, it is not necessary to alert it if an aeroplane is crossing its travel lane beyond its turning zone. On the other hand, if the carrier deviates from its taxiing directive or if the latter is not known to the system, the latter must anticipate the manoeuvres of the carrier as a function for example of its current behaviour or analyse ail the possible situations while limiting itself to a certain taxiing distance or a certain duration.

What is claimed is:

1. A cockpit system for aiding the guidance of a first aircraft travelling around an airport zone, the cockpit system comprising:

a first avionics system to determine a safety zone around the first aircraft taking into account at least a position of the aircraft, a wingspan of the aircraft, and an uncertainty in a measurement of the position, wherein the first avionics system is part of the first aircraft;

a second avionics system to determine a taxiing indication based on information from a first database about one or more bulkiness and performance characteristics of the first aircraft, information from a second database about one or more geometric and technical characteristics of the airport zone, information from a third database about air traffic in an immediate environment of the first aircraft, and one or more characteristics of the safety zone, wherein the second avionics system is part of the first aircraft; and a viewing system to display at least one view of the airport zone in which the first aircraft is situated and a representation of the taxiing indication, wherein the view of the airport zone is at least one of a compliant or perspective representation, wherein the viewing system is part of the first aircraft, and wherein, when the taxiing indication is a stop directive for the first aircraft, the representation of the taxiing indication is a stop barrier comprising a symbolic representation of a second aircraft justifying the first aircraft to stop.

2. The cockpit system of claim 1, wherein an orientation of the symbolic representation of the second aircraft is representative of a direction of travel of the second aircraft with respect to the first aircraft.

3. The cockpit system of claim 1, wherein an orientation of the symbolic representation of the second aircraft is representative of at least one of: a taxiing of the second aircraft, a landing of the second aircraft, or a takeoff of the second aircraft.

4. The cockpit system of claim 1, wherein the representation of the taxiing indication comprises one or more indications relating to a topological distance separating the first aircraft from the second aircraft and a speed of the second aircraft.

5. The cockpit system of claim 1, wherein the representation of the taxiing indication comprises a stop time indication.

* * * * *